United States Patent [19]

Gemmel

[11] 4,364,560

[45] Dec. 21, 1982

[54] HOCKEY STICK PRACTICE WEIGHT

[76] Inventor: John F. Gemmel, 59 Maryland St., Winnipeg, Manitoba, Canada, R3G 1K6

[21] Appl. No.: 317,796

[22] Filed: Nov. 4, 1981

[30] Foreign Application Priority Data

Oct. 4, 1978 [CA] Canada ..... 312664

[51] Int. Cl.[3] ..... A63B 21/00; A63B 59/12; A63B 69/00

[52] U.S. Cl. ..... 273/1 B; 273/26 B; 273/29 A; 273/67 A; 273/194 B

[58] Field of Search ..... 273/1 B, 26 B, 29 A, 273/67 A, 80 A, 194 B, 72 R, 72 A; 272/117, 122, 123

[56] References Cited

U.S. PATENT DOCUMENTS

| | | | |
|---|---|---|---|
| 3,508,748 | 4/1970 | Strimel | 273/26 B |
| 3,608,907 | 9/1971 | Bouchard | 273/194 B |
| 3,680,870 | 8/1972 | Burnett et al. | 273/194 B |
| 3,740,053 | 6/1973 | Eiger | 273/194 B |
| 3,758,117 | 9/1973 | Harrison | 273/194 B |
| 3,834,697 | 9/1974 | McNamara, Jr. | 273/1 B |
| 3,940,134 | 2/1976 | Bieganowski | 273/67 A |
| 4,023,797 | 5/1977 | Sarrasin | 273/1 B |
| 4,052,059 | 10/1977 | Rigsby | 273/67 A |
| 4,052,061 | 10/1977 | Stewart | 273/29 A X |
| 4,142,721 | 3/1979 | Faleck | 273/29 A X |

FOREIGN PATENT DOCUMENTS

| | | | |
|---|---|---|---|
| 936553 | 11/1973 | Canada | 273/67 A |

*Primary Examiner*—Richard C. Pinkham
*Attorney, Agent, or Firm*—Stanley G. Ade

[57] ABSTRACT

A U-shaped weight to engage the hockey stick shaft or handle anywhere along the length thereof, and is clamped in position by clamp screws. A flexible cover is secured by one end thereof to one side of said weight and is wrapped around the weight to cover the clamp screws and the weight and overlaps the one end and is fastened thereto by a friction fastener such as Velcro.

4 Claims, 4 Drawing Figures

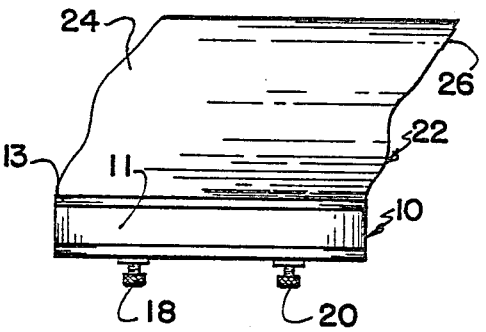
FIG. 1
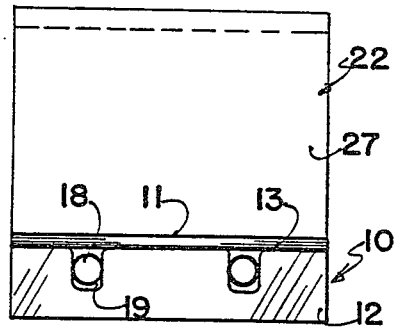
FIG. 2
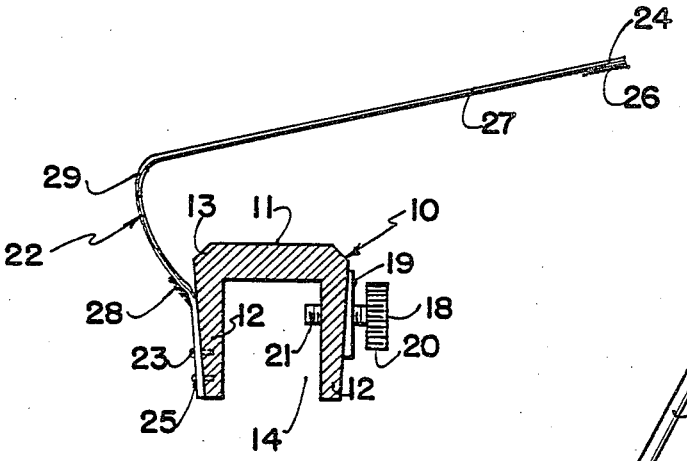
FIG. 3
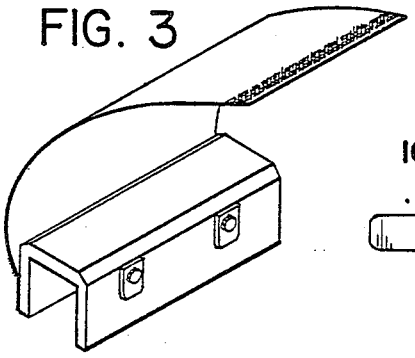
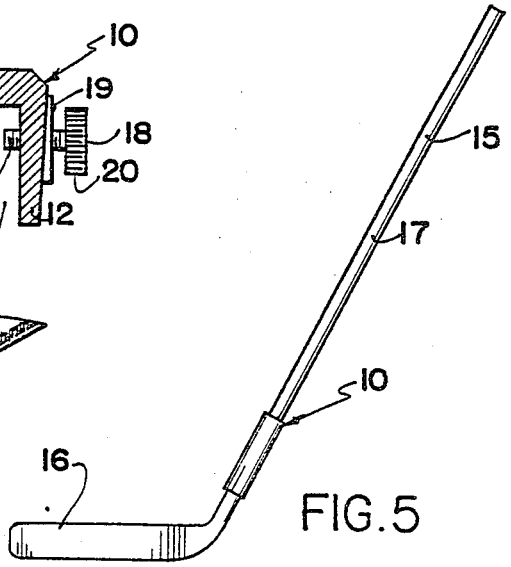
FIG. 5
FIG. 4

HOCKEY STICK PRACTICE WEIGHT

BACKGROUND OF THE INVENTION

This invention relates to new and useful improvements in hockey stick practice weights.

It is well known that a weight attached to the shaft of a device such as a baseball bat, golf club or the like, assists in training the muscles and also timing and rhythm normally called coordination.

To date, such practice weights have not been available for ice hockey due to the difficulty in adapting existing weights to hockey sticks which are of a totally different shape and construction.

SUMMARY OF THE INVENTION

The present invention provides a weight which is easily engaged anywhere along the length of a hockey stick handle and which furthermore can be attached and detached readily and easily.

This is accomplished by providing a U-shaped weight, the internal shape of which is substantially equal to the cross sectional configuration of the hockey stick so that the weight can be slipped onto the handle without having to be engaged over the butt end thereof. Means are provided so that the weight can be detachably secured to the hockey stick handle and, in the preferred embodiment, this means the form of clamp screws engaging through the weight and engaging the handle.

One aspect of the invention consists of a practice weight for hockey stick handles, said handles being substantially rectangular in cross section and including upper and lower edge faces and a pair of side faces; comprising a U-shaped weight engageable on said handle, and means on said weight for detachably securing said weight on said handle in the desired location therealong.

Another advantage of the invention is to provide a device of the character herewithin described which is simple in construction, economical in manufacture, and othewise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention, in which:

DESCRIPTION OF THE DRAWINGS

FIG. 1 is a top plan view of the device.

FIG. 2 is a side view thereof.

FIG. 3 is an end view thereof.

FIG. 4 is an isometric view of the weight per se.

FIG. 5 is a view of a hockey stick with the device secured in position.

In the drawings like characters of reference indicate corresponding parts in the different figures.

DETAILED DESCRIPTION

Proceeding therefore to describe the invention in detail, the weight collectively designated 10 is preferably cast from lead or similar material to give relatively high weight in a relatively small size.

It consists of a substantially rectangular bridging plate 11 with a pair of spaced and parallel side plates 12 extending downwardly from each longitudinal edge area 13 of the bridging plate so that the side plates 12 are held in spaced and parallel relationship one with the other as clearly shown in FIG. 3.

The dimensions of the handle engaging area 14 defined by the inner surfaces of the bridging plate 11 and the side plates 12, are such that the device readily engages over a hockey stick handle 15 in a relatively snug relationship.

When engaged as aforesaid, it will be observed that the side plates 12 engage the side faces 16 (only one of which is shown) and the inner surface of the bridging plate 11 engages either the upper or lower edge face 16 or 17, depending upon which way the weight is engaged upon the stick handle.

Means are provided to detachably secure the weight in position anywhere along the length of the stick handle and the preferred embodiment includes a pair of clamp screws 18 screw threadably engaged through screw threaded apertures formed in one of the side plates 12. In this connection, side plate is thickened at these areas as indicated by reference character 19. These clamp screws are preferably knurled as indicated by reference character 20 and extend through the side plate to engage the side face 16 of the hockey stick. In this connection, the inner end 21 of the screw may be slightly pointed as shown in FIG. 3. Although though two such screws 18 are shown, nevertheless one or any number of such screws may be provided, if desired.

By positioning the weight along the length of the handle, the desired weight relationship to the center of gravity can be obtained and if necessary, more than one weight can be used on a stick to produce even more weight if desired.

The use of these weights improves a player's coordination, timing and rhythm. Furthermore, it results in building up and developing the wrist and arm muscles and muscles used in stick handling and in shooting.

In order to protect players against injury or damage caused by weight 10 and the clamp screws 18, I have provided a flexible cover strip collectively designated 22. This may be formed from a rectangular piece of fabric such as flexible plastic, leather or the like and is secured to one of the side plates 12 by means of rivets 23 or some similar means. It is long enough to wrap entirely around the weight and cover the clamp screws 18 with the distal end 24 overlapping the attaching end 25 and being detachably secured to hold the flexible cover firmly in position. I prefer to use a friction fastening means such as that known by the registered trade mark VELCRO. It consists of a strip hook material 26 secured as by sewing or adhesive on the inner surface 27 of the flexible cover adjacent the distal end 24 thereof. This detachably engages with the strip of hook engaging material 28 secured as by sewing or adhesive to the outer surface 29 of the flexible cover just above the rivet 23 so that it can be engaged snugly around the weight once it is situated upon the hockey stick handle.

This flexible cover not only covers the clamp screws but also acts as a safety device in the event that the clamp screws become loosened inadvertently. Under these circumstances, the cover retains the weight upon the stick so that the weight merely slides down the stick but does not become disconnected therefrom.

Finally, reference should be made to the knurled screws 18. In the preferred embodiment these screws are made of plastic which is slightly resilient so that, when tightened, the screws grip the stick and the pressure exerted when the screws are tightened, causes the threads to bind slightly within the screw threaded drillings so that vibration, when the stick is in use, does not loosen the screws. Furthermore, the knurling is preferably parallel to the axis of the screw so that the screw heads cannot be gripped too tightly thus tending to prevent over torquing.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A practice weight for hockey stick handles, said handles being substantially rectangular in cross section and including upper and lower edge faces and a pair of side faces; comprising a U-shaped weight engageable on said handle, means on said weight for detachably securing said weight on said handle in the desired location therealong, and a flexible cover means secured by one end thereof to said weight to wrap around said weight when secured to said stick in order to cover said weight, and means to secure the other end of said cover means to itself when wrapped around said weight.

2. The weight according to claim 1 in which said weight includes a bridging plate and a pair of spaced and parallel side plates extending from the longitudinal edges of said bridging plate, said bridging plate, when in position upon said handle, engaging one of said upper and lower edge faces with said side plates engaging one upon each of said side faces.

3. The weight according to claim 2 in which said means for detachably securing said weight on said handle includes at least one clamp screw screw threadably engageable through one said side plates and clampably engaging with the side face of said hockey stick, said flexible cover means also covering said clamp screw when wrapped around said weight.

4. The weight according to claims 1, 2 or 3 in which said means to detachably secure the other end of said cover means to itself, takes the form of friction fastening means on the inner surface of said cover means adjacent said other end and on the outer surface of said cover means adjacent said one end, said friction fastening means cooperating together to hold said cover means wrapped around said weight and retaining said weight upon said handle if said clamping screw loosens.

* * * * *